US007041921B2

(12) United States Patent
Kadan et al.

(10) Patent No.: US 7,041,921 B2
(45) Date of Patent: May 9, 2006

(54) SWITCHING DEVICE

(75) Inventors: Paul Kadan, Vienna (AT); Adolf Tetik, Vienna (AT); Franz Reil, Kritzendorf (AT)

(73) Assignee: Moeller Gebäudeautomation KG, Schrems (AT)

( * ) Notice: Subject to any disclaimer, the term of this patent is extended or adjusted under 35 U.S.C. 154(b) by 0 days.

(21) Appl. No.: 10/827,112

(22) Filed: Apr. 19, 2004

(65) Prior Publication Data

US 2005/0230231 A1 Oct. 20, 2005

(51) Int. Cl.
*H01R 13/70* (2006.01)

(52) U.S. Cl. ..... 200/293; 439/721

(58) Field of Classification Search ..... 200/51 R, 200/51.01–17, 293–296, 727; 439/721, 722, 439/723, 725

See application file for complete search history.

(56) References Cited

U.S. PATENT DOCUMENTS

| | | | | |
|---|---|---|---|---|
| 3,289,049 | A | 11/1966 | Middendorf | |
| 3,775,733 | A * | 11/1973 | Ege | 439/724 |
| 3,858,130 | A | 12/1974 | Misencik | |
| 4,273,408 | A * | 6/1981 | Orr | 439/723 |
| 4,400,672 | A * | 8/1983 | Bottelson | 200/296 |
| 4,527,849 | A * | 7/1985 | Marach | 439/721 |
| 4,758,186 | A * | 7/1988 | Barriuso et al. | 439/723 |
| 4,776,815 | A * | 10/1988 | Baillet et al. | 439/724 |
| 5,664,971 | A | 9/1997 | Coy | |
| 5,747,741 | A | 5/1998 | Alsch | |
| 6,255,608 | B1 * | 7/2001 | Kawata et al. | 200/51 R |
| 6,614,334 | B1 | 9/2003 | Gibson et al. | |

FOREIGN PATENT DOCUMENTS

| | | |
|---|---|---|
| EP | 0 338 868 A | 10/1989 |
| EP | 0 683 498 A | 11/1995 |
| EP | 1 100 104 A | 5/2001 |
| WO | WO 02/080328 A | 10/2002 |

* cited by examiner

*Primary Examiner*—Lincoln Donovan
*Assistant Examiner*—M. Fishman
(74) *Attorney, Agent, or Firm*—Henry M. Feiereisen

(57) ABSTRACT

In a switching device (S) for electrical installations with a housing (2) having terminals (1), it is proposed for increasing the safety margin against spark-over between electrically conducting outside sections of two adjacent, identically constructed switching elements to provide at least one shielding element (3) that is formed as one-piece on the housing in a region of the terminals (1), or at least one recess (8), indentation (8) and the like, for lengthening the leakage current path on at least one housing part and/or on at least one section formed on the housing (2). In addition, in a switching device (S) for an electrical installations having a housing (2), with at least one terminal (1), means are provided for completely unscrewing the clamping screw (15) from the clamping opening (17) for easy insertion of ring cable lugs.

12 Claims, 3 Drawing Sheets

SWITCHING DEVICE

BACKGROUND OF THE INVENTION

The invention relates to a switching device, in particular a circuit breaker, for electrical installations, with a housing having terminals.

Such switching devices are employed in various applications as circuit breakers, in particular mains circuit breakers.

Electrical switching devices have to satisfy certain mandated safety regulations. The tight arrangement of electrical switching devices, for example in control boxes, makes it necessary to implement certain safety features for such switching devices.

Regulations, such as the US UL 489, define a minimum separation between the current-carrying conductors of adjacent electric switching devices that are accessible from the outside. For example, for switching devices operating at a voltage $U_N$ not exceeding 300 V, an air gap of at least 19.1 mm is required between adjacent current-carrying conductors. For an operating voltage of $U_N$>300 V, the required minimum air gap between two adjacent current-carrying conductors is already 25.4 mm.

Such air gaps between the densely arranged switching devices are implemented by increasing the housing widths. The resulting switching devices have housing volumes or housing widths that would otherwise not be required for their intended function. This not only increases the space requirements, but also the costs associated with their manufacture, storage and transport.

SUMMARY OF THE INVENTION

It is an object of the present invention to provide a switching device of the aforedescribed type, which has a high safety margin against spark-over between the electrically conducting outside elements of two adjacent, identically constructed switching devices, without significantly changing the width of the switching device.

The object is achieved by the invention in that at least one shielding element is provided that is formed as one-piece on the housing.

In this way, the air gap to an adjacent switching device and to its terminals can be increased, while the width of the switching device remains the same. Accordingly, switching devices with almost identical outside dimensions, for example low voltage devices, can be used at higher operating voltages.

In an embodiment of the invention, the at least one shielding element is formed as an essentially flat plate or a rib. This approach can increase the air gap to a neighboring device in a simple and space-saving manner.

Moreover, in an embodiment of the invention, the at least one shielding element can include at least one reinforcing rib. The shielding element can then withstand higher mechanical stress, for example during installations, without suffering damage. Damaged shielding elements increase the safety risk.

According to another embodiment of the invention, two spaced apart shielding elements can be provided. By arranging two shielding elements, the required air gap with respect to the terminals of an adjacent switching device is present on two sides of the switching device.

According to another embodiment of the invention, the shielding elements can be arranged essentially parallel around the terminal openings and/or the fastening screw opening of the terminals. This represents the most effective way to shield electrical fields.

Particularly leakage currents on the a housing parts of electrical components represent a safety risk in addition to the spark-over between the electrically conducting portions of two adjacent switching devices. Such electric spark-over cannot only occur through the air. The housing walls of the electric device represent significantly less resistance for the electric current than an air gap. Accordingly, the required minimum path lengths along a housing wall are greater so as to prevent conduction between two adjacent terminals through leakage currents.

The leakage current path typically corresponds to the current path in air when several switching devices are arranged side-by-side. For this reason, switching devices that satisfy the required minimum leakage current path, are typically larger than would otherwise be necessary for the equivalent leakage current path in air. Narrow component types which are customary in low voltage range can therefore no longer be used above a certain operating voltage.

It is therefore another object of the invention to provide a switching device that obviates the known disadvantages and that provides with preferably the same outside dimensions increased safety against leakage currents between the electrically conducting outside sections of two adjacent, identically constructed switching devices.

The object is achieved by the invention in that at least one recess, indentation and the like are provided on at least one housing part and/or on at least one element formed on the housing for the purpose of lengthening the leakage path.

In this way, with the same housing width, the leakage current path can be significantly lengthened, which keeps that dimensions of switching devices identical to those of low voltage switching devices even for higher operating voltages.

In an embodiment of the invention, the at least one recess, indentation and the like can be provided on the outside of at least one shielding element formed on the housing. The shielding elements of two adjacent, otherwise identical switching devices are than no longer placed on top of one another, resulting in a significantly lengthened leakage current path due to the separation between the shielding elements.

According to an embodiment of the invention, the at least one recess, indentation and the like can be arranged in the region of a terminal. In this way, the path of the occurring leakage current is most effectively lengthened when identical switching devices are arranged side-by-side.

According to another embodiment of the invention, a corresponding recess, indentation and the like can be arranged on the outside of the housing on either side of the fastening screw opening. With this housing geometry, the clamping screw openings in identical switching devices arranged side-by-side represent a particular risk due to leakage currents, which can be effectively suppressed in this manner.

The invention also relates to a switching device, in particular a circuit breaker, for electrical installations with a housing, with at least one terminal, including a movable case, a stationary case surrounding the movable case, and a clamping screw that can be screwed with a head against a clamping support through a through-opening disposed on the fixed case into a thread of the movable case, wherein the movable case together with the fixed case form a clamping opening for cable ends that can be adjusted with the clamping screw, further including a clamping opening for cable lugs that is formed between the head of the clamping screw and the fixed case Switching devices with such terminals are known and frequently used. However, such terminals are only suitable to clamp cable ends and so-called fork cable lugs. Such terminals can only be used with great difficulty or not at all with ring cable lugs.

In order to clamp a ring cable lug, the clamping screw has to be completely moved away from the clamping opening so as to enable insertion of the ring cable lug into the clamping opening.

In some embodiments of switches, means are provided to prevent the clamping screw from falling out of the cable terminal. Such switches are not suitable at all for operating with a ring cable lugs.

In embodiments that permit removal of the clamping screw from the terminal, a special tool or gravity is required. Aside from the fact that installed electrical devices can often not be brought in a position where the clamping screws can drop out, dropping conducting components can also represent a higher safety risk in an electrically sensitive environment. Applying special tools to remove the clamping screw from the clamping region also represents an unsatisfactory solution. Handling a screw with pliers is difficult, and the screw can still get lost.

It is therefore an object of the invention to provide a switching device, whereby the known disadvantages can be obviated and ring cable lugs can be safety used with such switching device.

The object of the invention is achieved by means that allow the clamping screw to be completely unscrewed from the clamping opening.

In this way, the clamping screw can reliably be moved out of the clamping region for insertion of a ring cable lug, without requiring additional tools, without the aid of gravity, and without removing the clamping screw completely from the switching device.

According to an embodiment of the invention, the means for completely unscrewing the clamping screw from the clamping opening includes an thread-free portion of the clamping screw located next to the clamping screw head. In this way, a means can be provided adjacent to the screw that is not affected by the screw thread.

According to an embodiment of the invention, the thread-free portion of the clamping screw can have a tapered cross-section. In this way, a region can be formed on the clamping screw that is suitable to receive a section with an inside thread, without moving this section.

According to another embodiment of the invention, the means for completely unscrewing the clamping screw from the clamping opening can include a platelet that is arranged on the side of the clamping support of the terminal that faces away from the case and is oriented parallel and non-rotatably relative to the clamping support, with the thickness of the platelet not exceeding the height of the thread-free region of the clamping screw.

According to another embodiment of the invention, the platelet can have a through-opening for the clamping screw which can include at least portions of a thread. According to another feature of the invention, such platelet with an interior thread can be arranged on the thread-free tapered cross-section of the clamping, without adversely affecting the clamping screw when using the clamping opening for cable ends in normal operation. When the clamping screw it is unscrewed from the thread of the movable case, the threaded portion of the platelet entrains the screw, so that the screw can now be completely screwed out of the clamping region which is now formed between the platelet and the clamping support.

BRIEF DESCRIPTION OF THE DRAWING

The invention will be described in more detail with reference to the appended drawings which illustrate certain embodiments. It is shown in.

DETAILED DESCRIPTION OF PREFERRED EMBODIMENTS

Figure 1:
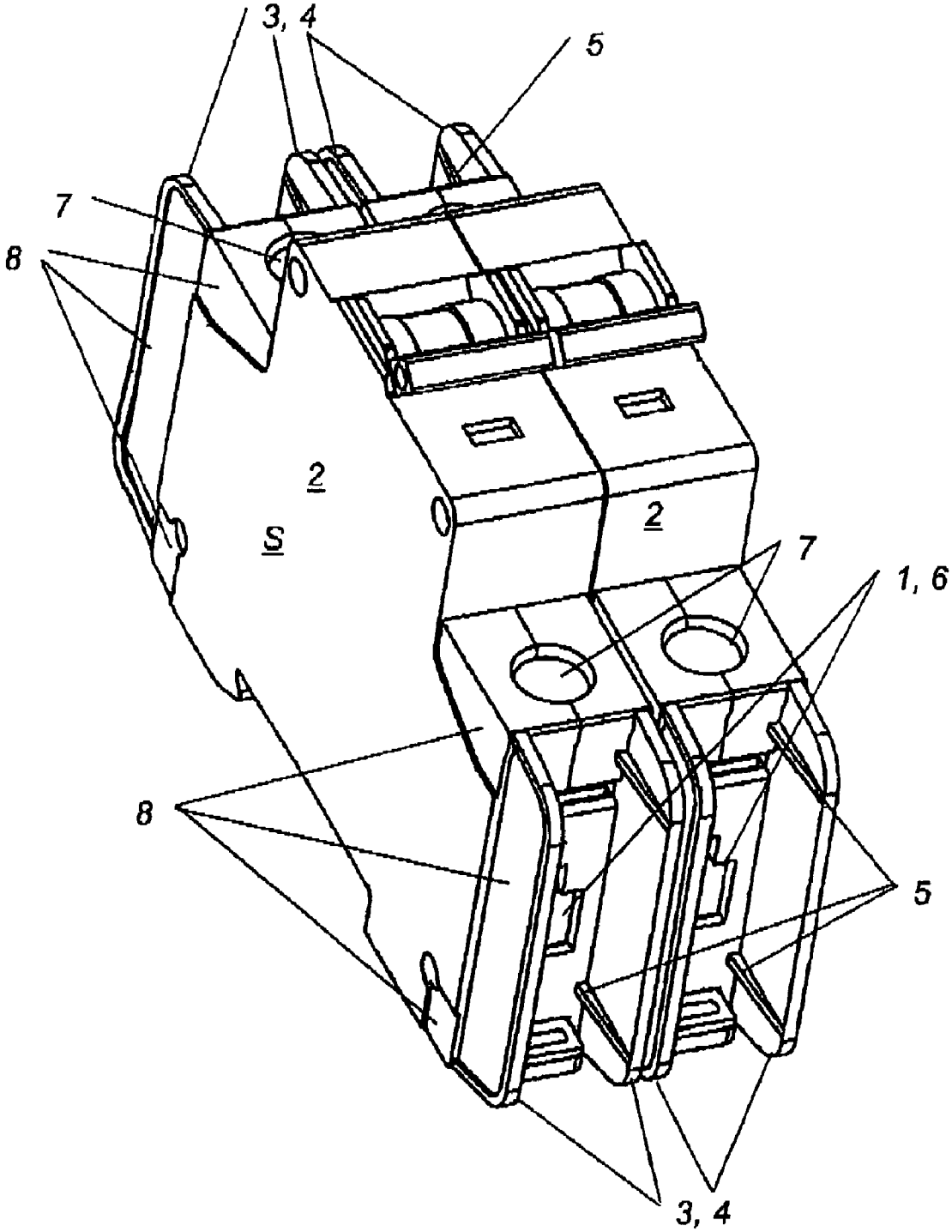
FIG. 1 an axonometric view of two switching devices.
Figure 2:
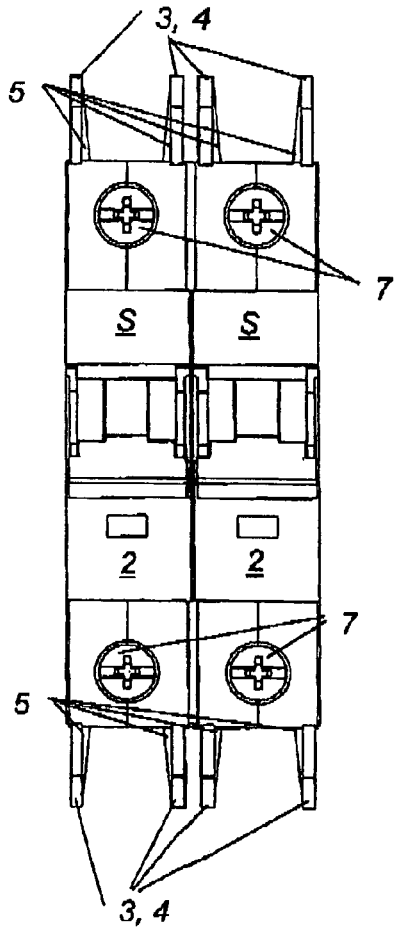
FIG. 2 a plan view of two switching devices according to FIG.1.
Figure 3:
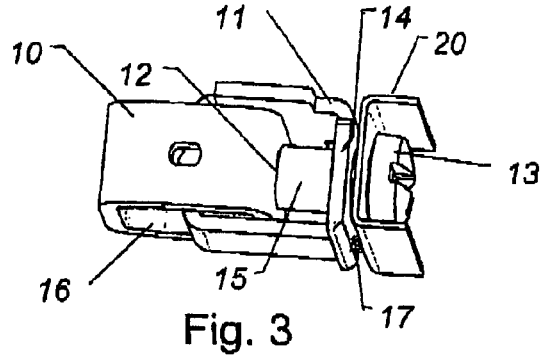
FIG. 3 an axonometric view of a terminal of a switching device.
Figure 4:
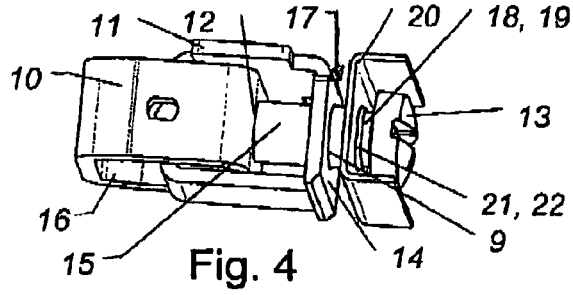
FIG. 4 a terminal according to FIG. 3.

FIGS. 1 and 2 depict two switching devices S according to the invention, in particular circuit breakers, for electrical installations with a housing 2 having terminals 1, wherein in the region of the terminals 1 at least one shielding elements 3 is provided that is formed as one-piece on the housing 2.

In control boxes and fuse boxes, various switching devices S, in particular circuit breakers, are arranged in a tight space. In order to house the largest possible number of such switching devices S in a limited area, the devices are typically relatively narrow and configured so that they can advantageously be arranged side-by-side in a space-saving manner. When the devices are densely arranged side-by-side, the risk of a spark-over due to an insufficient safety separation between the exposed current-carrying conductors increases. These conductors typically represent portions of the terminals 1 that cannot be completely insulated. Accordingly, the safety separation between the current-carrying conductors has to be observed.

Comprehensive regulations, for example US UL 498, require a minimum separation between externally accessible current-carrying conductors that a switching device S must satisfy before the device can be commercially sold. For example, an air gap of at least 19.1 mm between adjacent current-carrying conductors is required for switching devices S operating at a voltage $U_N$ not exceeding 300V. The required minimum air gap between two adjacent current-carrying conductors for an operating voltage of $U_N$>300V is 25.4 mm.

Typically, switching devices S employed at voltages not exceeding 300V satisfy the required minimum air gap solely by adapting the size of the housing 2 required to house the electromagnetic and/or mechanical components of the switching device S. Switching devices with these outside dimensions could also be used at significantly higher operating voltages. However, the required minimum air gap between adjacent current-carrying conductors would then not be satisfied.

The minimum air gap between adjacent current-carrying conductors required at operating voltages in excess of 300V results in housing dimensions which cannot be justified by the functionality of the switching device S alone. Mainly the width of the switching device S increases, thus significantly reducing the number of identically constructed switching devices S that can be accommodated in a certain area.

This disadvantage can be overcome and switching devices S with smaller outside dimensions, in particular with a smaller width, can be used at high operating voltages, by providing switching devices S according to the invention, in the region of the terminals 1 with at least one shielding element 3 that is formed as one piece on the housing 2. In this way, the housing width can be the same as that for low voltage switching devices (e.g., approximately 17.5 mm). A significantly larger number of switching devices S can then be accommodates in a predetermined area than has been possible to date.

Advantageously, at least one shielding element 3 is formed as an essentially flat plate 4 or rib 4. Such plate 4 or rib 4 makes it possible to increase the air gap between terminals 1 of adjacent switching devices S in a particularly simple manner. The actual shape of such plate 4 or rib 4, as well as the shape of a shielding element 1 according to the invention, are not essential for the invention, but are a consequence of the housing dimensions and the required air gap between two adjacent switching devices S.

Shielding elements 3, in particular plates 4 and/or ribs 4, which are frequently made of thin-walled plastic material, have a significant risk of sustaining damage when handled improperly, in particular during installation of the terminals or the switching device, where a shielding element 3 can be damaged or brake off. Damaged or missing electric shielding elements 3 represent a safety risk and can cause devices or facilities to malfunction or injure people. Advantageously, at least one shielding element 3 includes at least one reinforcement rib 5. Such a reinforcement rib 5 is easy to implement and significantly increases the mechanical stability of the shielding element 3. The type and the actual configuration of the reinforcement rib 5 can be adapted to the specific requirements.

The invention is more particularly directed to the use of switching devices S intended for a side-by-side arrangement and distinguished by identical housing dimensions. In particular, when it is unclear before installation on which of the outside surfaces the next switching device S will be arranged, the switching device S can advantageously include two spaced apart shielding elements 3.

The air gap between the current-carrying portions of two adjacent switching devices S can be most effectively lengthened when the shielding elements 3 are arranged essentially parallel about the clamping openings 6 and/or the clamping screw opening 7 of the terminals. In this way, the air gap can be most effectively lengthened with minimal use of shielding elements 3, regardless where the particular switching device S is located in this assembly of switching devices.

The potential conductive path through air between two adjacent current-carrying sections is not the only safety risk when operating electrical switching devices S in a confined space. Practically every solid material, even insulators, has a significantly smaller resistance than air. Parasitic electric currents, so-called leakage currents, can propagate along housing surfaces and thereby provide an electrically conducting connection with an adjacent switching device S.

Regional regulations have been established that specify the minimum leakage current paths between exposed current-carrying conductors of two adjacent switching devices S that have to be satisfied by the switching devices S. Since the housing 2 presents to the electric current a smaller resistance than air, the required minimal leakage current paths are longer than would otherwise be necessary for air gaps. For example, US UL 486 requires a clear path of at least 31.8 mm between adjacent current carrying conductors of switching devices that operate at voltage $U_N$ not exceeding 300V. For an operating voltage of $U_N$>300V, the required leakage current path between two adjacent current-carrying conductors is 50.8 mm.

Conventional switching devices S arranged side-by-side without additional constructive measures would have a leakage current path that is equal to the air gap. As a result, electric switching devices S that satisfy the required leakage current paths are several times larger than would otherwise be necessary to safely satisfy the switching functions. This significantly increases the required installation space and the associated cost.

FIGS. 1 and 2 show two switching devices S arranged side-by-side, in particular circuit breakers for electric installations with a housing 2 with terminals 1, whereby at least one recess 8, subsequently also referred to as indentation 8, for lengthening the leakage current path are provided on at least one housing section and/or on at least one part formed on the housing 2.

The recesses 8 or indentations 8 seen clearly in FIG. 1 significantly lengthen the existing leakage current path compared to conventional components without changing housing width. The configuration, number and shape of the recesses 8 or indentations 8 depend on the local situation and are adapted to the geometry of the respective switching devices S. As seen clearly in FIG. 1, such recesses 8 or indentations 8 can also be provided on the shielding elements 3.

The recesses 8 or indentations 8 also cause the shielding elements 3 to be offset toward the inside, which is seen clearly in FIG. 2. For example, the at least one recess 8 or indentation 8 can be provided on the exterior surface of at least one shielding element 3 formed on the housing 2. The shielding elements 3, which are implemented in FIG. 2 as a plate or a rib 4, are moved away from the housing surfaces towards the inside by a distance that prevents the shielding elements 3 from contacting another identically constructed switching device S or another shielding element 3 of that switching device S. The shielding elements 3 of adjacent switching devices S are then not in contact with one another, thereby lengthening the leakage current path.

Advantageously, the at least one recess 8 indentation 8 is arranged in the region of a terminal 1, because this can be an area where leakage currents can be expected. Advantageously, a corresponding recess 8 or indentation 8 is arranged on the exterior side of the housing on either side of the clamping screw opening 7. In this way, the leakage current path can be most effectively lengthened, while removing only a minimum of material from the housing surface.

FIGS. 3 to 6 shows the terminal 1 of a switching device S, in particular a circuit breaker, for electrical installations with a housing 2, with at least one terminal 1, including a movable case 10, a fixed case 11 surrounding the movable case 10, and a clamping screw 15 that can be screwed with a head 13 against a clamping support 14 through a through-opening 9 of the fixed case 11 into a thread 12 of the movable case 10, wherein the movable case 10 together with the fixed case 11 forms a clamping opening for cable ends 16 that can be adjusted with the clamping screw 15, further including a clamping opening 17 for cable lugs R that is formed between the head 13 of the clamping screw 15 and the fixed case 11, wherein means are provided for completely unscrewing the clamping screw 15 from the clamping opening 17.

Switching devices S frequently have terminals 1 adapted to receive cable ends and/or fork cable lugs.

So-called ring cable lugs R can only be clamped with great difficulty or not at all with such terminal 1. When inserting a ring cable lugs R in a terminal 1, the clamping screw 15 must move out of the clamping region 17 before the clamping support 14.

It is not uncommon to provide means that prevent the clamping screw 15 from falling out of the clamping screw opening 7. Switching devices S with such terminals are unsuitable for operating with ring cable lugs R. If the clamping screw 15 can be removed at all, then special tools or gravity must be used.

The means provided in the switching device S of the invention make it possible to completely unscrew the clamping screw 15 from the clamping opening 17, thereby enabling the operation of a switching device S according to the invention with ring cable lugs R.

The means for completely unscrewing the clamping screw 15 from the clamping opening 17 include a clamping screw 15 with a thread-free region 18 that is located next to the screw head 13 and has a tapered cross-section 19 smaller than the cross-section of the thread.

The means for completely unscrewing the clamping screw 15 from the clamping opening 17 further include a platelet 20 that is arranged on the side of the clamping support 14 of the terminal 1 that faces away from the case 11 and is oriented parallel and non-rotatably relative to the clamping support 14. The thickness of the platelet 20 does not exceed the height of the thread-free region 18 of the clamping screw 15. The platelet 20 can further include a through-opening 21 for the clamping screw 15 which includes at least portions of a thread 22. This through-opening 21 can have an open edge. In this way, a particularly simple partial thread 22 can be realized.

The platelet 20, which can have a shape different from that depicted in FIGS. 3 to 6, is arranged between the clamping support 14 of the fixed case 11 and the clamping screw 15 and can be supported on the housing parts. It should be noted, however, that the platelet 20, before contacting the housing parts, can move away from the clamping support 14 by a certain distance that is sufficient to enable the hereby generated gap between the clamping support 14 and the platelet 20 to receive a ring cable lug R. Other embodiments capable of receiving more than one ring cable lug R can also be envisioned.

When the terminal 1 is closed or partially closed, for example when clamping a cable end, the platelet 20 is arranged on the thread-free region 18, 19 of the clamping screw 15 with the tapered cross-section. The clamping screw 15 must then be screwed through the platelet 20.

Figure 5:
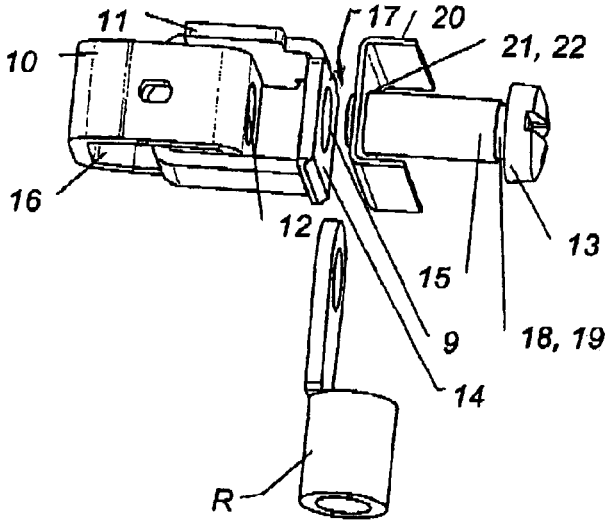
FIG. 5 a terminal according to FIG. 3 with a ring cable lug.

For opening the terminal 1 so that the clamping screw 15 moves out of the way of the clamping opening for cable lugs R, the screw 15 is operated so as to open the terminal 1. If the terminal 1 is fully open and the clamping screw continues to move in the same direction, then the clamping screw 15 becomes unscrewed from the last turns of the thread 12 in the movable case 10. The clamping screw 15 is then raised above the clamping support 14 and entrains the platelet 20, until the platelet 20 is prevented from moving further by housing parts. If the clamping screw 15 is rotated further, then the thread of the clamping screw 15 is screwed into the partial thread 22 of the platelet 20. Because the housing parts prevent the platelet 20 from moving radially, further rotation of the clamping screw 15 moves the clamping screw 15 out of the fixed case 11 and out of the clamping opening for cable lugs R, as indicated in FIG. 5. When the clamping opening 17 is unobstructed, a ring cable lug R can be inserted in the clamping opening 17. When the clamping opening 17 is fully open, the clamping screw 15 can protrude so far from the clamping screw opening 17 that it can be manually removed. However, removal of the clamping screw 15 is not required for operating a switching device S with ring cable lugs R.

In a preferred embodiment of the switching device S of the invention, means are provided that prevent the clamping screw 15 from falling out of the clamping screw opening 7. This can be achieved, for example, by a small reduction in the diameter in the clamping screw opening 7. The clamping screw 15 can then no longer exit from or be removed from the clamping screw opening 7.

The length of the clamping screw 15 must be selected so as to urge, when completely unscrewed from the thread 12 of the movable case 10, the platelet 20 against the housing 2, causing the partial thread 22 of the platelet 20 to engage with the thread of the clamping screw 15. However, the length of the thread 12 of the movable case 10 can also be selected so as to satisfy this condition.

The terminal 1 can be closed by turning the clamping screw 15 in the appropriate direction. Shortly before the clamping screw 15 disengages from the partial thread 22 of the platelet 20, the clamping screw 15 engages with the thread 12 of the movable case 10 and can now be closed in a conventional manner.

Figure 6:
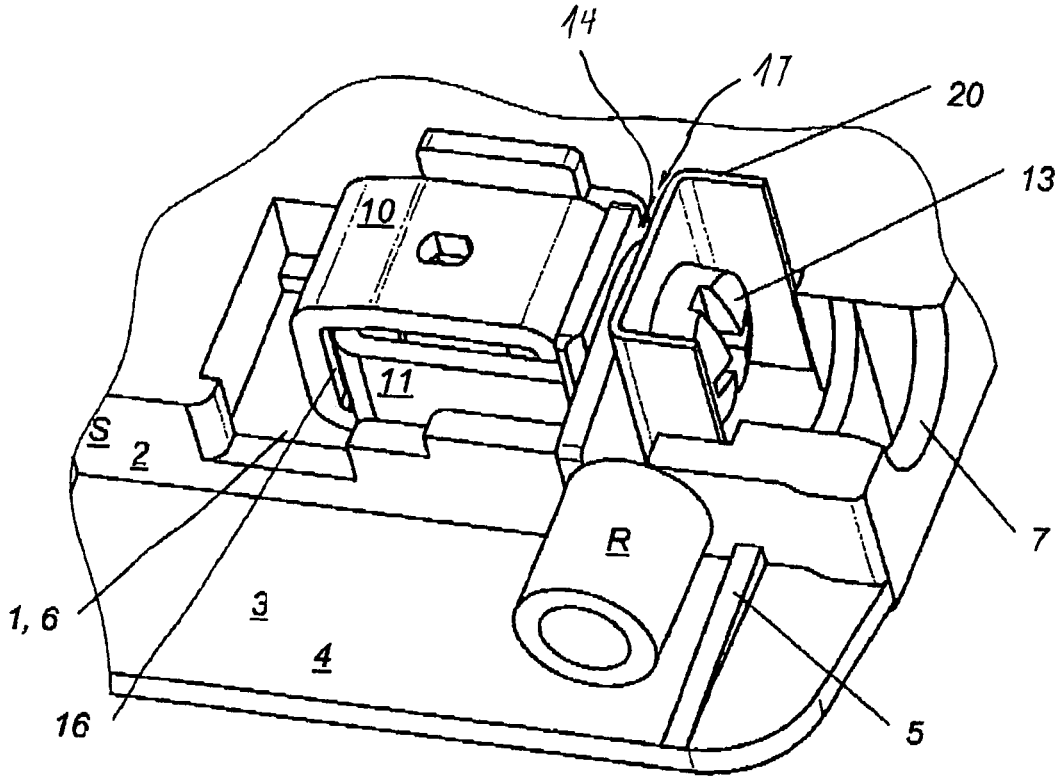
FIG. 6 a cross-sectional view of a switching device according to FIG. 1 with a cable lug according to FIG. 5 in an axonometric view.

FIG. 6 shows a switching device S with a shielding element 3 and a terminal 1 with a ring cable lug R connected to terminal 1.

What is claimed is:

1. A switching device for an electrical installation, comprising:

a housing having a bottom section and a top section spaced apart from the bottom section by a height;

at least two spaced-apart terminals disposed on the housing, each terminal having a clamping opening and shielding elements;

formed as one-piece on the housing in a region proximate to the terminal and extending along the corresponding clamping opening substantially over the entire height of the housing, wherein adjacent claming openings are separated by at least two shielding elements which are open at at least one of the top and bottom sections and have a gap therebetween.

2. The switching device of claim 1, wherein the at least one shielding element is formed as an essentially flat plate or a rib.

3. The switching device of claim 1, wherein the at least one shielding element includes at least one reinforcing rib.

4. A switching device for an electrical installation, comprising:

a housing having a lateral exterior surface and a bottom section and a top section spaced apart from the bottom section by a height;

a terminal disposed on the housing; and at least one shielding element formed as one-piece substantially on the lateral exterior surface of the housing in a region proximate to the terminal, said at least one shielding element offset from the lateral exterior housing surface towards the inside of the housing by a distance that prevents the at least one shielding element from contacting an adjacent shielding element of another switching device placed adjacent to the switching device, thereby lengthening a leakage path between adjacent switching devices, wherein the shielding elements are open at at least one of the top and bottom sections.

5. The switching device of claim 4, further comprising at least one recess or indentation disposed on an exterior section of at least one shielding element.

6. The switching device of claim 5, wherein the at least one recess or indentation is disposed in a region of a terminal.

7. The switching device of claim 6, comprising two recesses or indentations and a fastening screw opening, wherein one of the recesses or indentations is disposed on an exterior section of the housing on one side of the fastening screw opening and another of the recesses or indentations is disposed on an exterior section on another side of the fastening screw opening.

8. The switching device of claim 4, further comprising:

a movable case having a thread and a clamping support;

a fixed case surrounding the movable case and having a through-opening;

a clamping screw disposed on the fixed case and including a thread-free region with a tapered cross-section located next to the clamping screw head, said clamping screw intended for threaded engagement into the thread of the movable case through the through-opening disposed on the fixed case so as to urge a head of the clamping screw against the clamping support disposed on the movable case;

an adjustable clamping opening for cable ends or cable lugs formed between the movable case and the fixed case, said clamping opening being adjustable with the clamping screw; and a platelet disposed on a side of the clamping support that faces away from the fixed case and oriented parallel to the clamping support, the platelet being prevented from rotating relative to the clamping support, the platelet having a through-opening for the clamping screw which includes at least portions of a thread, wherein the thickness of the platelet does not exceed a length of the thread-free region of the clamping screw.

9. The switching device according to claim 1, further comprising a fastening screw opening disposed on the terminals, wherein the shielding elements are disposed around the fastening screw opening essentially in parallel with the fastening screw opening.

10. The switching device according to claim 1, wherein the switching device is a circuit breaker.

11. The switching device according to claim 4, wherein the switching device is a circuit breaker.

12. The switching device of claim 11, wherein the at least one recess or indentation extend across substantially the entire height of the housing.

* * * * *

UNITED STATES PATENT AND TRADEMARK OFFICE

CERTIFICATE OF CORRECTION

PATENT NO. : 7,041,921 B2
APPLICATION NO. : 10/827112
DATED : May 9, 2006
INVENTOR(S) : Paul Kadan et al.

It is certified that error appears in the above-identified patent and that said Letters Patent is hereby corrected as shown below:

Column 8, line 43: change “claming” to --clamping--

Signed and Sealed this

Fourth Day of July, 2006

JON W. DUDAS
*Director of the United States Patent and Trademark Office*